United States Patent [19]

Lawrance et al.

[11] Patent Number: 4,846,262

[45] Date of Patent: Jul. 11, 1989

[54] HEAD CLOSURE APPARATUS FOR HEAT EXCHANGER

[75] Inventors: Harold R. Lawrance; John R. McCutchen, both of Tulsa, Okla.

[73] Assignee: Connell Limited Partnership, Boston, Mass.

[21] Appl. No.: 249,223

[22] Filed: Sep. 22, 1988

Related U.S. Application Data

[63] Continuation of Ser. No. 8,865, Jan. 30, 1987, abandoned.

[51] Int. Cl.[4] ..... F28F 9/06

[52] U.S. Cl. ..... 165/72; 165/158

[58] Field of Search ..... 165/158, 176, 72

[56] References Cited

U.S. PATENT DOCUMENTS

| | | | |
|---|---|---|---|
| 2,237,029 | 4/1941 | Fischer | 165/176 X |
| 2,296,620 | 9/1942 | Tinker | 165/158 X |
| 2,298,511 | 10/1942 | Rathbun | 165/158 X |
| 2,816,679 | 12/1957 | Tinker | 165/72 X |
| 2,920,789 | 1/1960 | Tinker | 165/72 X |
| 3,258,068 | 6/1966 | Hollister | 165/176 X |
| 3,605,880 | 9/1971 | Smith | 165/158 |
| 4,325,428 | 4/1982 | Schuurman | 165/158 X |
| 4,630,673 | 12/1986 | Belleli | 165/158 |
| 4,750,554 | 6/1988 | Oeij et al. | 165/72 X |

*Primary Examiner*—Ira S. Lazarus
*Assistant Examiner*—Peggy Neils
*Attorney, Agent, or Firm*—James Albert Drobile; Robert A. Koons, Jr.

[57] ABSTRACT

The invention discloses a novel head closure apparatus for shell and tube-type heat exchangers. The disclosed apparatus is substantially resistant to thermal stress cracking in that it has an internal closure chamber configured to withstand and dissipate thermal stresses caused by rapidly changing thermal gradients. The apparatus also provides for full access to the entire interior volume of the head closure and to the entire area of the head closure inner tubesheet surface in order to facilitate maintenance and repairs. The invention also discloses a compact and efficient retaining key apparatus for constraining the end-cover of a cylindrically-shaped head closure member against internal working pressures. The apparatus enables substantial reductions in the masses of the retaining keys, the head closure member, and the end-cover, which results in the head closure apparatus being simpler and more economical to manufacture and maintain.

5 Claims, 3 Drawing Sheets

HEAD CLOSURE APPARATUS FOR HEAT EXCHANGER

This application is a continuation of application Ser. No. 07/008,865 filed Jan. 30, 1987 now abandoned.

BACKGROUND OF THE INVENTION

1. Field of the Invention

The invention relates to pressure vessels or heat exchangers, and more particularly to a head closure apparatus for use with shell and tube-type heat exchangers.

In particular, the invention relates to an easily maintainable heat exchanger head closure apparatus suitable for cyclical modes of operation over rapidly changing thermal gradients, in that the apparatus is highly resistant to thermal stress cracking which has become a problem in heat exchangers presently being used in the electrical power generation industry, among others.

The invention also relates particularly to a compact and efficient retaining key apparatus for constraining the end-cover of an internally cylindrical heat exchanger head closure against internal working pressures.

2. Description of the Prior Art.

In prior shell and tube-type heat exchanger construction, two distinctly different types of head closure configurations have been known and used. The first type of known head closure construction is one having spherical internal and external geometry. Such spherical heat exchanger head closures possess the benefits of allowing relatively thin-wall construction under applicable ASME Code specifications, while retaining excellent strength characteristics so as to be highly resistant to thermal stress cracking caused by rapidly changing thermal gradients during start-up and shut-down of heat exchangers. However, spherical heat exchanger head closures are distinctly disadvantageous because access to the interior of the head closure generally is by means of a limited manhole opening, which does not allow for full access to the entire interior area of the heat exchanger tubesheet or to the entire interior volume of the head closure for necessary maintenance and repairs. As a result of this limited access opening, spherical heat exchanger head closure configurations generally are disfavored by many users of heat exchangers, including specifically the electric power generation industry.

The second type of heat exchanger head closure configuration previously known and used is one that has cylindrical internal and external geometry. Such cylindrical head closures generally have end-covers secured against internal working pressure by various means. An advantage of cylindrical head closures, as compared to spherical head closures, is that, when the end-cover of a cylindrical head closure is removed, full and complete access is provided to the entire interior volume of the head closure and to the entire interior area of the heat exchanger tubesheet. This full and complete access facilitates repairs and maintenance to the tubesheet and surrounding interior volume of the head closure. As a result, cylindrical heat exchanger head closures for many years have been widely favored and used by the electric power generation industry, among others.

One means known in the prior-art for securing the end-covers of cylindrical head closures involves a plurality of segmented annular retaining keys having multiple vertical-faced shear nodules that engage corresponding annular grooves inside the cylindrical head closure member. The disadvantage of such prior-art retaining keys is that the vertical-faced shear nodules must be spaced relatively far apart from each other, such that the retaining keys are lengthy and cumbersome and require that the overall length of the cylindrical head closure member must be increased to accommodate the shearing forces transmitted to the head closure member through the retaining keys. This in turn requires that the overall thickness of the end-cover must also be increased so that the access opening end-surface of the head closure member and the outer surface of the end-cover are maintained in a co-planar relationship in order to facilitate proper hydraulic sealing between the head closure member and the end-cover. As a result, the end-covers used with such prior-art retaining keys are substantially thicker and of substantially greater mass than otherwise required by applicable ASME Code specifications, which, together with the increased length of the head closure member, makes the cylindrical head closure apparatus unnecessarily expensive and difficult to manufacture and maintain.

It has developed that, prior to 1980, many electric power generating facilities economically were operated to meet base-load requirements, which resulted in such facilities operating for extended time periods without being removed from service. As a result, the large numbers of prior-art shell and tube-type heat exchangers having cylindrical head closures used by such electric power generating facilities generally were operated in substantially continuous modes involving relatively lengthy periods of steady-state operation, with such heat exchangers being only randomly and infrequently taken out of service. As a result, the heat exchangers with cylindrical head closures installed in many older electric power generating facilities generally were designed and suitable for relatively constant service, as opposed to daily start-up and shut-down cyclical modes of operation.

Today, however, many of these older electric power generating facilities that originally were designed for base-load continuous service now are being used as "peaking" facilities, which requires that such facilities be started-up and partially or totally shut-down on daily or other relatively short cyclical frequencies. As a result of such cyclical operation, it has developed that the prior-art cylindrical heat exchanger head closures used in those older electric power generation facilities are incapable of withstanding such cyclical operation, in that the rapidly changing thermal gradients caused in such cylindrical heat exchanger head closures by such cyclical operation have been shown to result in substantial thermal stress cracking of such cylindrical head closures. Such thermal stress cracking most commonly occurs at the points of structural discontinuities between the barrel walls of the cylindrical closure members and the tubesheet surfaces of the head closures. These thermal stress cracking problems have resulted in extended outages of numerous electric power generating facilities, with attendant large losses in revenue and greatly increased maintenance expenses to the electric power generation industry.

Although prior-art spherical heat exchanger head closures generally are capable of withstanding the severe thermal stresses caused by cyclical operation of electric power generating facilities, the owners of such facilities largely have chosen not to install spherical head closures due to the limitations on access to the interiors of spherical head closures and the attendant difficulty of maintenance and repairs, as described above.

OBJECTS OF THIS INVENTION

It is an object of this invention to provide a heat exchanger head closure apparatus having relatively low mass which gives it the ability to change temperature more quickly and with less severe thermal gradients than heat exchanger head closures of relatively greater mass.

It is a further object of this invention to provide a heat exchanger head closure apparatus having a configuration which provides for greater structural flexibility to withstand and dissipate thermal stresses caused by rapidly changing thermal gradients.

It is a further object of this invention to provide a heat exchanger head closure apparatus that provides full access to the entire interior volume of the head closure and to the entire area of the head closure inner tubesheet surface in order to facilitate maintenance and repairs.

It is a further object of this invention to provide an improved retaining key apparatus for constraining the end-cover of a cylindrically-shaped head closure, while providing for the lowest overall mass of the retaining key apparatus, head closure member, and head closure end-cover.

These and other objects of the invention will be better appreciated after reading the succeeding description of the invention in conjunction with the accompanying drawings.

SUMMARY OF THE INVENTION

The invention is directed to a novel heat exchanger head closure apparatus suitable for cyclical operation which results in rapidly changing thermal gradients within the apparatus. Externally, the invention is configured as a cylinder, extending longitudinally from a planar tubesheet at one end, and terminating at the other end in a planar annulus that provides an access opening equivalent in size to the access openings in prior-art cylindrical head closures.

Internally, the invention is configured at its planar tubesheet end by having an augmented radius of curvature define a gradual geometric transition from the inner planar tubesheet surface into the surface of a spherically-shaped closure chamber, which surface of the spherically-shaped closure chamber longitudinally intersects the surface of a cylindrically-shaped closure chamber, which cylindrically-shaped closure chamber terminates longitudinally at the planar annulus that provides the access opening of the apparatus. The inner surface of the cylindrically-shaped closure chamber is configured to accept and constrain an appropriate end-cover and means of sealing against hydraulic leakage.

It is established that ASME Code specifications require that the wall thickness for internally cylindrical pressure vessels must be twice the wall thickness of internally spherical vessels operating under the same temperature and pressure conditions. As a result, it will be understood that the wall thickness at the thinnest point of the spherically-shaped closure chamber of the instant invention may be set so as to equal one-half of the wall thickness of the cylindrically-shaped closure chamber of the invention.

As a result, it will be appreciated that, not only is the overall mass of the present invention reduced as compared to prior-art cylindrical head closures, but there is enabled in the present invention a substantially larger internal radius of the spherically-shaped closure chamber, as compared to the internal radius of the cylindricallyshaped closure chamber, which in turn geometrically enables an augmented radius of curvature that defines a gradual geometric area of transition from the inner planar tubesheet surface into the surface of spherically-shaped closure chamber of the invention. This augmented radius of curvature and resulting gradual geometric area of transition, along with overall reduced mass of the invention, provide for effective distribution and dissipation of the substantial thermal stresses that arise from the rapidly changing thermal gradients caused by cyclical operation of heat exchangers, which have been shown to cause substantial thermal stress cracking problems at the junctures of the tubesheets and barrel walls of prior-art heat exchanger head closures having internally cylindrical configurations along their entire longitudinal lengths.

Thus, it has been discovered that the present invention combines a primary advantage of prior-art spherical heat exchanger head closures—specifically a high degree of resistance to thermal stress cracking at the juncture of the tubesheet and the head closure wall—with the additional advantage of providing full and complete access to the entire interior volume of the head closure member and to the entire area of the internal tubesheet surface, which advantage exists only in prior-art cylindrical head closures and is unattainable in prior-art spherical head closures.

The invention also is directed to an improved apparatus for retaining a head closure end-cover in the access-opening end of a heat exchanger head closure member having a closure chamber that is internally cylindrical in configuration. More particularly, the invention is directed to a plurality of annular retaining key segments with a first circumferential shear nodule with substantially vertical front and rear faces, and at least one additional circumferential shear nodule having a highly sloped front face and a substantially vertical rear face. The shear nodules are adapted to engage corresponding annular grooves in the interior surface of the internally cylindrical closure chamber, with the shear nodules being located immediately adjacent to each other so that the radial spatial projections of the shear-resisting areas of the shear nodules having highly-sloped front faces overlap the radial spatial projections of the corresponding opposing shear-resisting areas of the head closure member.

The use of retaining key segments having shear nodules with highly sloped front faces, and the attendant overlapping of the radially projected shear-resisting areas as between the retaining key segments and the head closure member, allow a substantial reduction in the overall width of the retaining key segments. This reduction in retaining key segment width in turn allows the overall longitudinal length of the head closure member to be reduced substantially, which in turn allows the thickness of the head closure end-cover to be significantly reduced so that such thickness is determined solely by applicable ASME Code specifications rather than by the necessity that the outer end-cover surface be co-planar with the annular end-surface of the head closure member to facilitate proper hydraulic sealing of the apparatus.

The achieved reductions in the width of the retaining key segments, in the longitudinal length of the head closure member, and in the thickness of the head closure end-cover result in a substantial reduction in the overall mass of the heat exchanger head closure apparatus, which facilitates more economical manufacture and maintenance of the head closure apparatus.

DETAILED DESCRIPTION OF THE INVENTION

The invention relates to pressure vessels or heat exchangers, and more particularly to a novel heat exchanger head closure apparatus specifically adapted to and suitable for cyclical operation which results in rapidly changing thermal gradients within the apparatus.

It has been found that the present invention is capable of changing temperature more rapidly and with less severe thermal gradients than prior-art internally cylindrical head closures. It also has been found that the internal configuration of the present invention provides greater flexibility and thus more readily accommodates rapidly changing thermal gradients than do prior-art internally cylindrical head closures. As a result, the present invention has been found to be substantially resistant to thermal stress cracking, while at the same time retaining the benefits of full and complete access to the entire inner tubesheet surface area and to the entire interior volume of head closure, which full and complete access is inherent in prior-art cylindrical, as opposed to prior-art spherical, heat exchanger head closures.

The present invention also is directed to an improved retaining key apparatus for constraining the end-covers of internally cylindrical heat exchanger head closures. This improvement allows the retaining key segments to be narrower in width and more compact than those in the prior art, which allows the length of the head closure member to be significantly reduced. This reduction in the length of the head closure member permits the concomitant thickness of the head closure end-cover to be reduced to the point that such end-cover thickness is determined solely by applicable ASME Code specifications as a function of the internal pressure and temperatures for which the head closure is designed, rather than by the requirement that the annular end surface of the head closure member and the outer surface of the end-cover be co-planar to facilitate proper hydraulic sealing of the apparatus. This results in the retaining key segments, the head closure member, and the head closure end-cover having substantially reduced overall masses as compared to prior-art internally cylindrical head closures, which in turn results in simpler and more economical manufacture and maintenance of the head closure apparatus.

Figure 1:
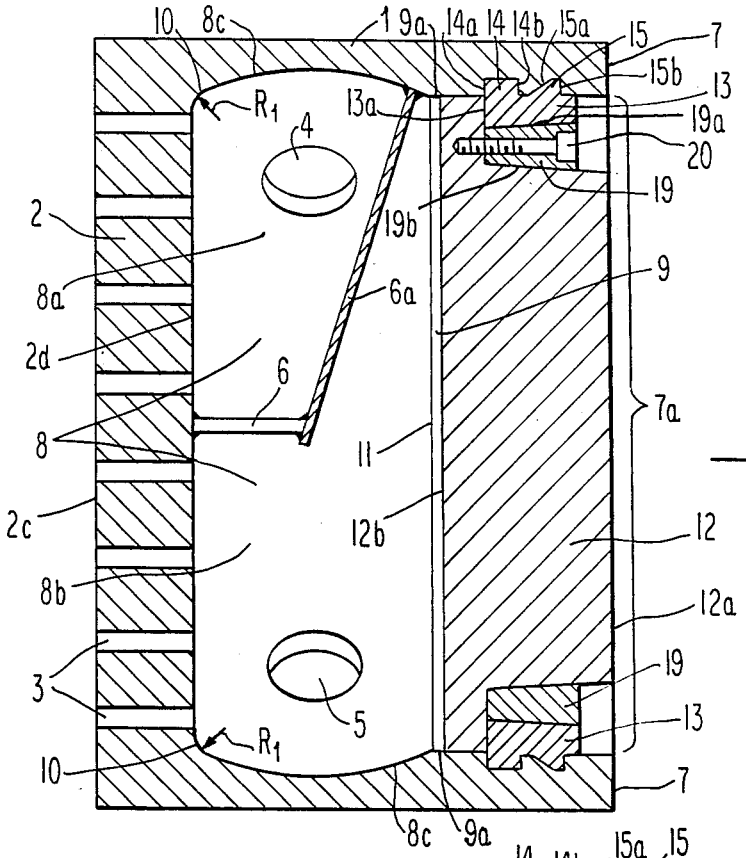
FIG. 1 is a schematic, vertical, longitudinal cross-sectional view of an apparatus of the invention.
Figure 2:
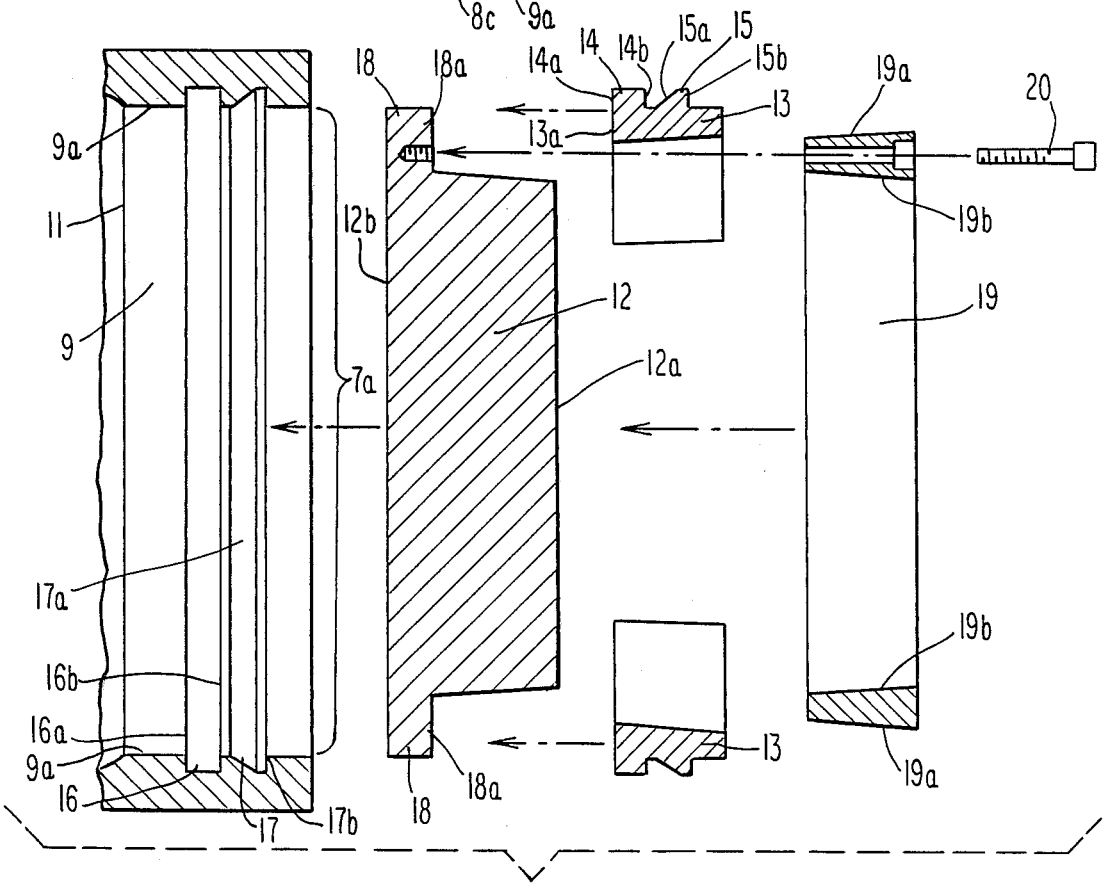
FIG. 2 is a fragmentary, schematic, vertical, longitudinal cross-sectional view of an apparatus of the invention in an "exploded" or disassembled condition.

Viewing FIG. 1 in conjunction with FIG. 2, it will be seen that the invention consists generally of a head closure member 1 suitable for use with a shell and tube-type heat exchanger. In order to withstand the substantial internal closure member 1 normally is constructed of forged steel or similar material. Head closure member 1 originates at one end with planar tubesheet 2, which incorporates a plurality of drilled tube holes 3, into which the tubes (not shown) of a heat exchanger may be interposed and rigidly attached to tube-sheet 2. Head closure member 1 incorporates inlet nozzle 4 and outlet nozzle 5, with baffle plates 6 and **6*a* separating inlet region 8*a* and outlet region 8*b* within head closure member 1**.

Externally, head closure member 1 is uniformly cylindrical in cross-section along its entire longitudinal length, such longitudinal length beginning at the outer surface **2*c* of tubesheet 2 and terminating at annular end surface 7 which provides access opening 7*a***.

Figure 4:
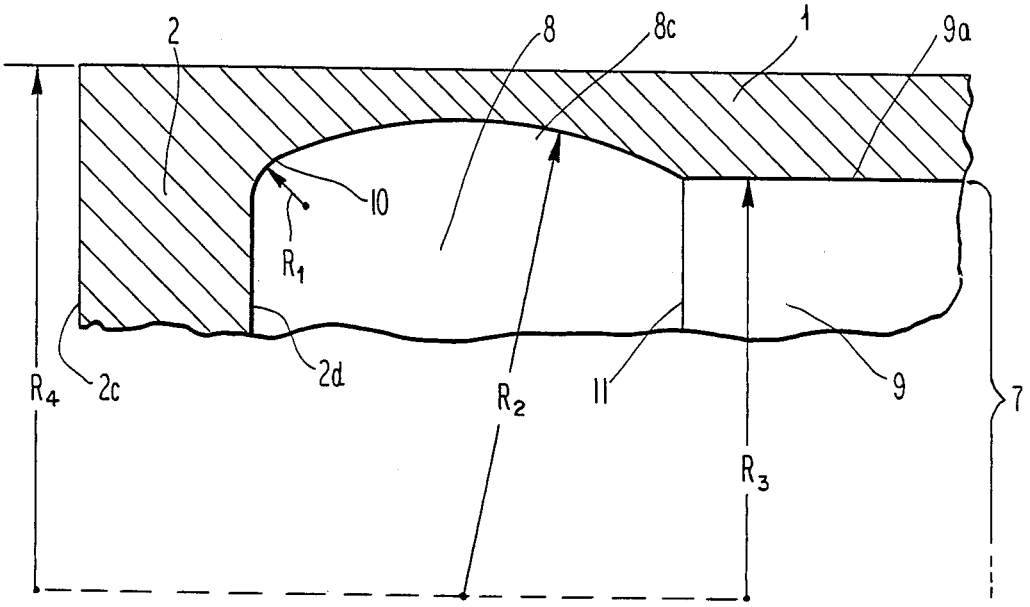
FIG. 4 is a fragmentary, schematic, vertical, longitudinal cross-sectional view of an apparatus of the invention, particularly showing the internal and external radii of an apparatus of the invention.

Now viewing FIGS. 1 and 2 in conjunction with FIG. 4, it will be seen that internally, head closure member 1 incorporates internal spherically-shaped closure chamber 8, having spherical inner radius R2, and internal cylindrically-shaped closure chamber 9, having cylindrical inner radius $R_3$. Spherically-shaped closure chamber 8 is separated into inlet region **8*a* and outlet region 8*b* by baffle plates 6 and 6*a*. Spherically-shaped closure chamber 8 originates at the inner surface 2*d* of tubesheet 2 with an augmented radius of curvature $R_1$ defining a gradual geometric area of transition 10 from inner surface 2*d* of tubesheet 2 into the surface 8*c* of spherically-shaped closure chamber 8. Surface 8*c* of spherically-shaped closure chamber 8 thereafter longitudinally intersects the surface 9*a* of cylindrically-shaped closure chamber 9 at transition plane 11. Cylindrically-shaped closure chamber 9 terminates longitudinally at the plane of annular surface 7 which provides access opening 7*a* of head closure member 1. Closure end-cover 12 is removably constrained within cylindrically-shaped closure chamber 9, for the purpose of withstanding the internal working pressure of head closure member 1 while facilitating full and complete access to the entire area of inner surface 2*d* of tubesheet 2 and to the entire internal volume of head closure member 1**.

It is established that the ASME Code specifications applicable to heat exchanger head closures for a given design temperature and pressure require that the wall thickness of a heat exchanger head closure having an internally cylindrical configuration must be twice the wall thickness of a heat exchanger head closure having an internally spherical configuration. As a result, it will be seen that, in the present invention, for a head closure member 1 with an outer cylindrical configuration having radius $R_4$ along its entire longitudinal length, spherical inner radius $R_2$ of spherically-shaped closure chamber 8 can be substantially greater than cylindrical inner radius $R_3$ of cylindrically-shaped closure chamber 9.

As a result of spherical inner radius $R_2$ being allowably greater than cylindrical inner radius $R_3$ as described above, it will be appreciated that, geometrically, a substantial augmented radius of curvature $R_1$ is enabled, which results in augmented radius of curvature $R_1$ defining the previously-described gradual geometric area of transition 10 between tubesheet inner surface 2*d* and surface 8*c* of spherically-shaped closure chamber 8.

In a preferred embodiment of the invention, the relative geometry of the invention may be established so that outer cylindrical radius $R_4$ is from approximately 18 inches to approximately 36 inches, with spherical inner radius $R_2$ being from approximately 12 inches to approximately 30 inches, and inner cylindrical radius $R_3$ being from approximately 10 inches to approximately 28 inches, thereby resulting in augmented radius of curvature $R_1$ being from approximately $1\frac{3}{4}$ inches to approximately 5 inches.

It has been found that the relatively low mass of closure member 1 in the region of spherically-shaped closure chamber 8, in conjunction with gradual geometric area of transition 10 between tubesheet inner surface 2*d* and surface 8*c* of spherically-shaped closure chamber 8 as enabled by augmented radius of curvature $R_1$, more effectively and efficiently dissipates and distributes the severe thermal stresses that otherwise would result from cyclical operation over rapidly changing thermal gradients. This has been found to result in the present invention being substantially resistant to the significant thermal stress cracking problems that have occurred at the points of physical discontinuities at the junctures of the inner tubesheet surfaces and the barrel side walls of prior-art heat exchanger head closure members that are internally cylindrical along their entire longitudinal lengths.

Now viewing FIG. 2 in conjunction with FIG. 1, it will further be appreciated that, in addition to achieving the substantial resistance to thermal stress cracking that previously was attainable only in heat exchanger head closures having spherical internal and spherical external configurations, the present invention provides the additional benefit of a substantial access opening 7*a*, which greatly facilitates maintenance and repairs to the entire area of inner tubesheet surface 2*d* and to the entire interior volume of closure member 1. It will further be appreciated that access opening 7*a* is physically and geometrically unattainable in prior-art head closure members having spherical internal and external configurations, and, as described above, substantial access openings such as access opening 7*a* previously have been possible only in heat exchanger head closure members that are internally cylindrical along their entire longitudinal lengths.

As a result, it will be seen that the present invention achieves the novel and previously unattainable combination of the advantages inherent in avoiding thermal stress cracking while enabling full and complete access to the entire area of tubesheet inner surface 2*d* and to the entire interior volume of head closure member 1.

The present invention also discloses an improved retaining key apparatus for constraining the end-cover of a heat exchanger head closure having a cylindrically-shaped closure chamber.

Figure 3:
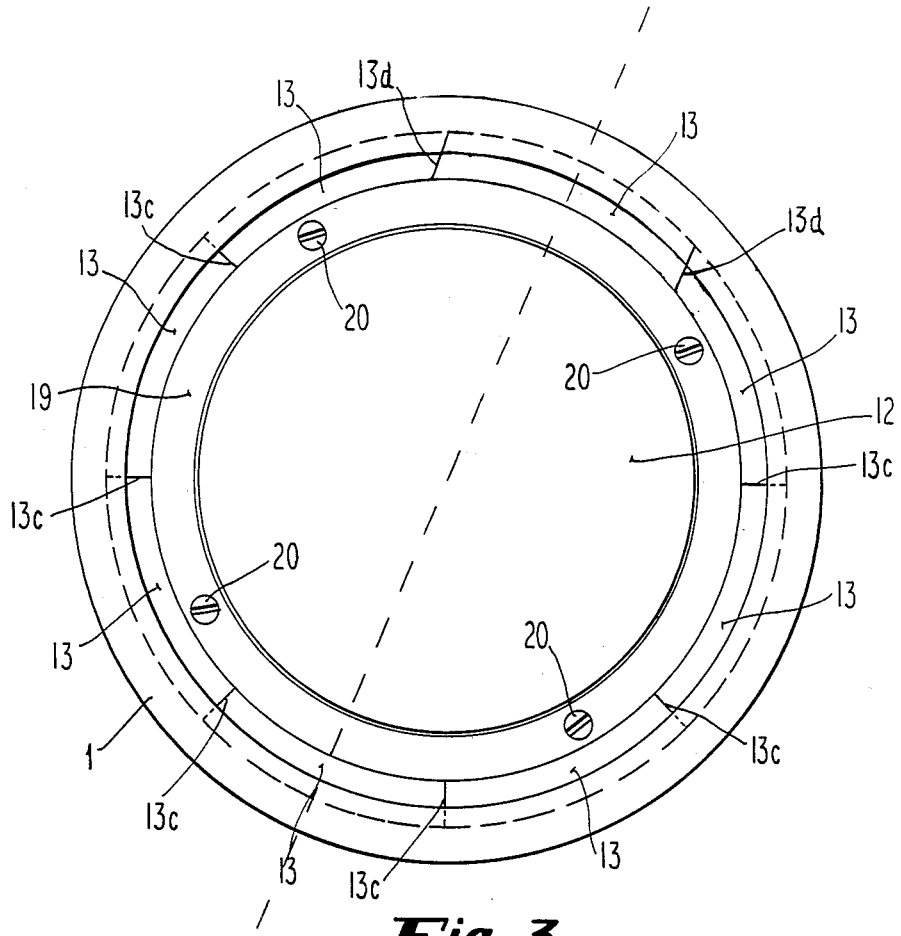
FIG. 3 is a schematic, vertical, cross-sectional end-view of the head closure end-cover, annular retaining key segments, and annular retaining key backing ring of an apparatus of the invention.

Viewing FIG. 1 in conjunction with FIG. 3, it will be seen that planar head closure end-cover 12 is removably disposed within cylindrically-shaped closure chamber 9 of head closure member 1 and secured by a plurality of annular retaining key segments 13 against the substantial internal working pressure of head closure member 1.

Annular retaining key segments 13 generally have radially divided ends 13*c*. However, one retaining key segment 13 is configured so that both of its ends 13*d* are parallel to each other and parallel to the radial center line of such retaining key segment 13, as shown in FIG. 3. Further, two additional retaining key segments 13 are configured so that each such additional retaining key segment 13 has one end 13*c* that is radially divided, and one end 13*d* that is parallel to the radial center line of the retaining key segment 13 having two parallel ends as described above, with such additional retaining key segments 13 being positioned immediately adjacent to retaining key segment 13 having two parallel ends 13*d*, as shown in FIG. 3. In this manner, the interposing of the entire plurality of retaining key segments 13 continuously around the inner circumference of cylindrically-shaped closure chamber 9 is geometrically facilitated.

In addition, it will be seen that retaining key segments 13 have radially formed into their outer circumferential surfaces a first shear nodule 14, having a substantially vertical front face 14*a* and a substantially vertical rear face 14*b*. It will further be seen that retaining key segments 13 have radially formed into their outer circumferential surfaces a second shear nodule 15 having a highly sloped front face 15*a* and a substantially vertical rear face 15*b*. Depending upon the magnitude of the internal pressure expected to be exerted within head closure member 1, any number of additional shear nodules having highly sloped front faces and substantially vertical rear faces may be radially formed into the upper circumferential surfaces of retaining key segments 13 immediately adjacent to shear nodule 15, one such additional shear nodule being shown by broken lines in FIG. 6.

Now viewing more particularly FIG. 2, it will be seen that cylindrically-shaped closure chamber 9 has a first annular groove 16 radially formed into surface 9*a* of cylindrically-shaped closure chamber 9, which first annular groove 16 corresponds to shear nodule 14, and has a substantially vertical front face 16*a* and a substantially vertical rear face 16*b*. Cylindrically-shaped closure chamber 9 also has a second annular groove 17 radially formed into surface 9*a* of cylindrically-shaped closure chamber 9, which second annular groove 17 corresponds to shear nodule 15 and is positioned immediately adjacent to annular groove 16, with annular groove 17 having a highly sloped front face 17*a* and a substantially vertical rear face 17*b*. Depending upon the magnitude of the internal pressure expected to be exerted within head closure member 1, any number of additional annular grooves having highly sloped front faces and substantially vertical rear faces may be provided in cylindrically-shaped closure chamber 9 immediately adjacent to annular groove 17 and corresponding to additional shear nodules with highly sloped front faces and substantially vertical rear faces as described above and shown by broken lines in FIG. 6.

Figure 7:
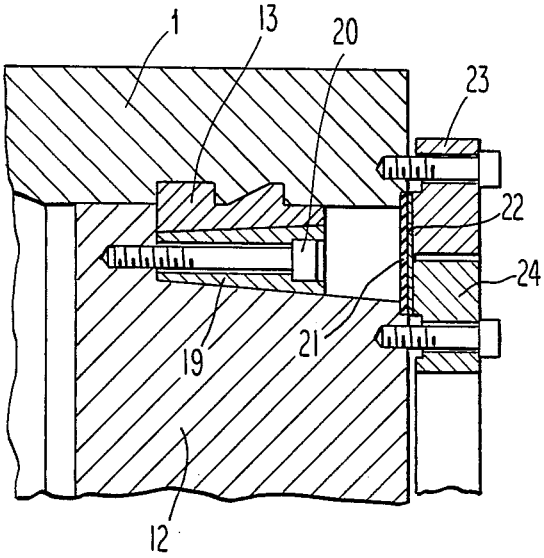
FIG. 7 is a fragmentary, vertical, longitudinal cross-sectional view of a means of hydraulically sealing an apparatus of the invention.
Figure 8:
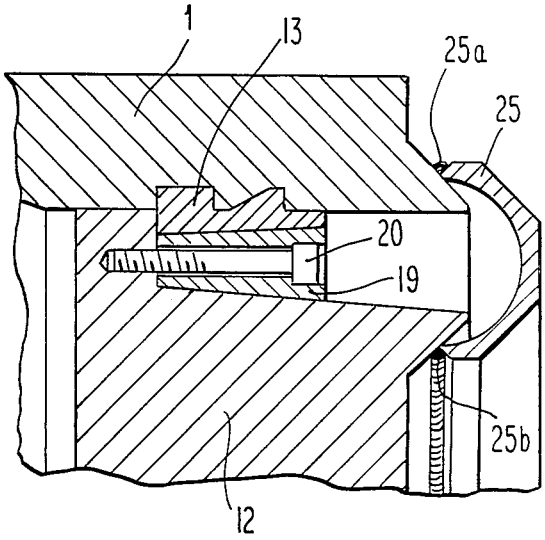
FIG. 8 is a fragmentary, vertical, longitudinal cross-sectional view of an alternative means of hydraulically sealing an apparatus of the invention.

Now viewing FIGS. 1 and 2 in conjunction with FIG. 3, it will be seen that, after closure end-cover 12 is interposed into cylindrically-shaped closure chamber 9 of closure member 1 so that annular retaining lip 18 formed into closure end-cover 12 is properly positioned immediately adjacent to annular groove 16, a plurality of retaining key segments 13 having shear nodules 14 and 15 geometrically can be interposed continuously around the entire inner circumference of cylindricallyshaped closure chamber 9 as described above. As a result, shear nodules 14 and 15 can by interposed into and caused to rigidly engage corresponding annular grooves 16 and 17, respectively, with a substantial portion of the lower front faces 13*a* of retaining key segments 13 rigidly engaging rear face 18*a* of end-cover annular retaining lip 18. Thereafter, retaining key backing ring 19 having sloped outer face 19*a* and sloped inner face 19*b* is interposed between retaining key segments 13 and closure end cover 12 as shown in FIGS. 1, 7, and 8, thereby causing retaining key backing ring 19 to bias retaining key segments 13 and shear nodules 14 and 15 such that shear nodules 14 and 15 remain rigidly engaged within corresponding annular grooves 16 and 17 in surface 9*a* of cylindrically-shaped chamber 9, and further such that the lower front faces 13*a* of retaining key segment 13 remain rigidly engaged to the rear face 18*a* of end-cover annular retaining lip 18. Retaining key backing ring 19 is maintained in its biasing position against retaining key segments 13 by means of a plurality of threaded fasteners 20 that rigidly attach retaining key backing ring 19 to end cover retaining lip 18 as shown in FIGS. 1, 7, and 8.

Figure 6:
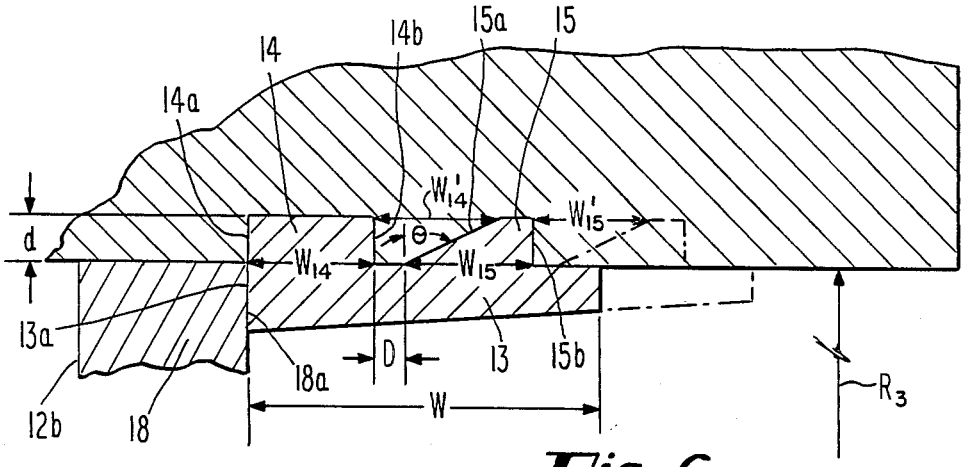
FIG. 6 is a fragmentary, schematic, vertical, longitudinal cross-sectional view of an annular retaining key segment of an apparatus of the invention.

Now viewing FIGS. 1 and 6, it will be appreciated that the substantial forces created by the internal working pressure within head closure member 1 will be exerted on the inner surface 12*b* of end-cover 12 and will be transmitted through end-cover retaining lip 18 and applied as a shearing force at the bases of shear nodules 14 and 15 across a total shear-resisting area calculated by multiplying the width $W_{14}$ of shear nodule 14 and the width $W_{15}$ of shear nodule 15 by the total inner circumference of cylindrically-shaped closure chamber 9 having radius $R_3$.

Now viewing FIG. 6, it will be appreciated that, for a given shearing force transmitted by end-cover retaining lip 18 to the bases of shear nodules 14 and 15 having widths $W_{14}$ and $W_{15}$ respectively, there will be an equal and opposing shearing force applied to the interior of head closure member 1 across a total opposing shear-resisting area calculated by multiplying width $W_{14}'$ and width $W_{15}'$ by the total inner circumference of cylindrically-shaped closure chamber 9 at annular grooves 16 and 17, at which point the inner radius of cylindrically-shaped closure chamber 9 is equal to $R_3+d$, where $R_3$ is the previously described inner radius of cylindrically-shaped closure chamber 9, and d is the incremental depth of annual groves 16 and 17 which is substantially equivalent to the incremental height of shear nodules 14 and 15.

It will further be appreciated that, in order for end-cover 12 to be safely and properly constrained in cylindrically-shaped closure chamber 9 against the shearing force transmitted by end-cover retaining lip 18 so as to avoid the failure of the interior of head closure member 1 in shear, the opposing shearresisting area calculated above using widths and $W_{14}'$ and $W_{15}'$ must at least be equal to the shear-resisting area across the bases of shear nodules 14 and 15 as calculated using widths $W_{14}$ and $W_{15}$.

Thus, it will be appreciated that, if the incremental depth d of annular grooves 16 and 17 conservatively is assumed to be negligible so that $R_3+d$ may be assumed to equal $R_3$, it is apparent that, in order to avoid the failure of the interior of head closure member 1 in shear as discussed above, safe and prudent spacing of annular grooves 16 and 17 requires that the sum of widths $W_{14}'$ and $W_{15}'$ across the interior of head closure member 1 must at least be equal to the sum of the widths $W_{14}$ and $W_{15}$ across the bases of shear nodules 14 and 15.

Figure 5:
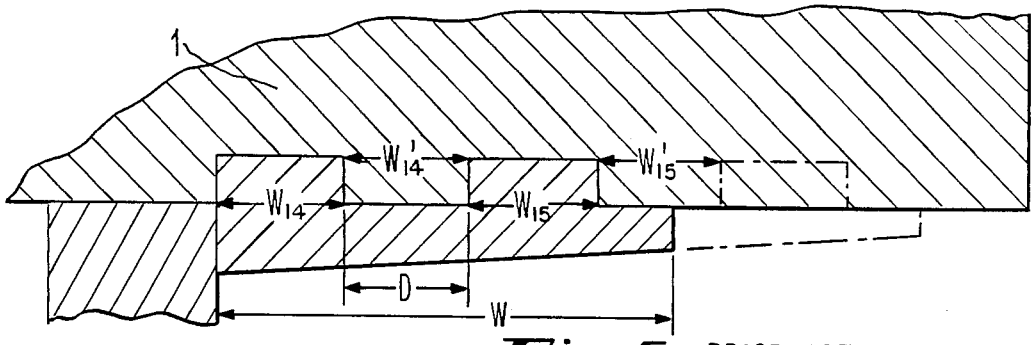
Fig. 5 PRIOR ART
FIG. 5 is a fragmentary, schematic, vertical, longitudinal cross-sectional view of an annular retaining key segment of a prior-art apparatus.

Now viewing FIG. 5 and keeping in mind the requirement that the sum of $W_{14}'$ and $W_{15}'$ must at least be equal to the sum of $W_{14}$ and $W_{15}$, it will be seen that, in prior-art retaining keys having shear nodules with vertical front and rear faces, such shear nodules must geometrically be spaced so that the distance D between shear nodules 14 and 15 is equal to the width $W_{14}'$ in the interior of head closure member 1.

Now viewing FIG. 6, it will be seen that, in the present invention, by having the radial spatial projection of the opposing shear-resisting area calculated using $W_{14}'$ overlap the radial spatial projection of the shear-resisting area of shear nodule 15 as calculated using $W_{15}$, the distance D between shear nodules 14 and 15 will be significantly less than width $W_{14}'$. It will further be appreciated that, in the present invention, although distance D between shear nodules 14 and 15 is greatly decreased as compared to the distance between the shear nodules in the prior-art retaining key segments shown in FIG. 5, the necessary relationship wherein the sum of $W_{14}'$ and $W_{15}'$ is at least equal to the sum of $W_{14}$ and $W_{15}$ is fully satisfied in the present invention, thereby enabling closure member 1 to properly withstand the equal and opposing shearing force transmitted to it by shear nodules 14 and 15.

In a preferred embodiment of the invention, it has been found that widths $W_{14}$ and $W_{15}$ of the bases of shear nodules 14 and 15 may be from approximately 1 inch to approximately $2\frac{1}{2}$ inches. Similarly, widths $W_{14}'$ and $W_{15}'$ of the opposing shear-resisting areas in head closure member 1 will be from approximately 1 inch to approximately $2\frac{1}{2}$ inches. The incremental depth d of annual grooves 16 and 17, which, it will be appreciated, corresponds substantially to the height of shear nodules 14 and 15, may be from approximately $1\frac{1}{2}$ inch to approximately 2 inches. Front face 15*a* of shear nodule 15 may be sloped at an angle $\theta$ from the vertical plane, as shown in FIG. 6, such angle $\theta$ being from approximately 50 degrees to approximately 70 degrees. It has further been found that distance D between shear nodules 14 and 15 may be from approximately $\frac{1}{4}$ inch to approximately $\frac{3}{4}$ inches, with the overall width W of retaining key segments 13 being from approximately 4 inches to 9 approximately inches.

Now further comparing FIGS. 5 and 6, it is apparent that, in the present invention, the relatively close spacing of shear nodules 14 and 15 results in a significant reduction in the overall width W of retaining key segments 13, as compared to the overall width of prior art retaining key segments. It also is apparent that, in retaining key segments 13 having additional shear nodules with highly sloped front faces, one such additional shear nodule being shown by broken lines in FIG. 6, the resulting reduction in the overall width W of retaining key segments 13 will be compounded with the addition of each additional shear nodule having a highly sloped front face, as compared to prior-art retaining key segments having an equal number of shear nodules with substantially vertical front and rear faces.

Now viewing FIG. 1 in conjunction with FIGS. 5 and 6, it will be appreciated that, as a result of the reduction in the overall width of retaining key segments 13 achieved by the present invention, there is enabled a corresponding reduction in the overall longitudinal length of head closure member 1. Having achieved such reduction in the overall longitudinal length of head closure member 1, the thickness of end-cover 12 also may be reduced, consistent with ASME Code specifications, such that the exterior surface 12*a* of end-cover 12 is maintained in a substantially co-planar relationship with the annular end surface 7 of closure member 1, as required by conventional means for sealing head closure member 1 and end-cover 12 against hydraulic leakage.

It has been found that the significant reductions in the overall masses of retaining key segments 13, of head closure member 1, and of head closure end-cover 12 achieved by the present invention result in a heat exchanger head closure apparatus that is significantly easier and more economical to manufacture and maintain as compared to those heat exchanger head closures necessitated by prior-art retaining key segments having multiple shear nodules with vertical front faces and vertical rear faces.

It being understood that the present invention allows end-cover 12 to be reduced in thickness while still remaining substantially co-planar with annular end-surface 7 at access opening 7*a* of head closure member 1 of reduced longitudinal length, it will be seen that end-cover 12 and closure member 1 may be sealed by conventional means so as to prevent hydraulic leakage.

Viewing FIG. 7, it will be seen that end-cover 12 and closure member 1 conventionally may be sealed against hydraulic leakage by means of an appropriate gasket 21, a gasket retaining plate 22, an outer gasket retaining ring 23 threadably attached to annular end surface 7 of closure member 1, and an inner gasket retaining ring 24 threadably attached to outer surface 12*a* of end-cover 12. Alternatively, viewing FIG. 8, it will be seen that endcover 12 and closure member 1 conventionally may be sealed against hydraulic leakage by having a torus ring 25 continuously welded at torus ring outer circumference 25*a* to closure member 1, with torus ring 25 being similarly continuously welded at torus ring inner circumference 25*b* to outer surface 12*a* of end-cover 12.

It will be appreciated that there is considerable variation that can be accomplished in the apparatus of the invention without departing from the spirit and scope of the invention, and it will further be appreciated that those variations are contemplated by the invention. For example, the external cylindrical radius $R_4$ of head closure member 1 may be varied depending upon the dimensions of the heat exchanger shell to which the invention is attached, and, in turn, spherical inner radius $R_2$ of spherically shaped closure chamber 8, cylindrical inner radius $R_3$ of cylindrically-shaped closure chamber 9, and augmented radius of curvature $R_1$ may be varied while retaining the described characteristics of the invention. By way of further example, the number of shear nodules having highly sloped front faces formed into retaining key segments 13, as well as the precise angle $\theta$ of such highly sloped front faces and the precise height and width of such shear nodules, may be varied within the limits required by the internal working pressure of head closure member 1 and the desired overall longitudinal dimensions of the heat exchanger head closure.

We claim:

1. A head closure apparatus for heat exchangers, comprising:

(a) a head closure member cylindrically shaped along its entire external longitudinal length, said head closure member originating at one end with a planar tubesheet having inner and outer surfaces and terminating at the other end with a planar annular surface providing an access opening having a cross-sectional area substantially equivalent to the cross-sectional area of said inner surface of said planar tubesheet, said head closure member having an internal spherically-shaped closure chamber and an internal cylindrically-shaped closure chamber, said internal spherically-shaped closure chamber originating at said inner surface of said planar tubesheet through an augmented radius of curvature defining a gradual geometric area of transition between said inner surface of said planar tubesheet and the surface of said internal spherically-shaped closure chamber for the purpose of dissipating thermal stresses and resisting thermal stress cracking, the surface of said internal spherically-shaped closure chamber longitudinally intersecting the surface of said internal cylindrically-shaped closure chamber in a plane parallel to and opposing said inner surface of said planar tubesheet, said internal cylindrically-shaped closure chamber terminating at said planar annular surface providing said access opening so that full and complete access to the entire interior volume of said head closure apparatus and to the entire area of said inner surface of said planar tubesheet is facilitated; and (b) a planar head closure end-cover adapted to be removably constrained within said internal cylindrically-shaped closure chamber, for the purpose of withstanding the internal working pressure of said head closure apparatus while enabling full and complete access to the entire interior volume of said head closure apparatus and to the entire area of said inner surface of said planar tube sheet.

2. A head closure apparatus for heat exchangers as recited in claim 1, further comprising a means for removably constraining said planar head closure end-cover within said internal cylindrically-shaped closure chamber so that said planar head closure end-cover is capable of withstanding the internal working pressure of said head closure apparatus.

3. A head closure apparatus for heat exchangers as recited in claim 2, further comprising a means for sealing said head closure member and said planar head closure end-cover against hydraulic leakage during operation of said head closure apparatus.

4. A head closure apparatus for heat exchangers as recited in claims 2 and 3, wherein said means for removable constraining said planar head closure end-cover comprises:

(a) a first annular groove with a substantially vertical front face and a substantially vertical rear face radially formed into the surface of said internal cylindrically-shaped closure chamber;

(b) at least one additional annular groove with a high sloped front face and a substantially vertical rear face radially formed into the surface of said internal cylindrically-shaped closure chamber between said first annular groove and said annular surface end of said head closure member;

(c) a plurality of annular retaining key segments having a first shear nodule with a substantially vertical front face and a substantially vertical rear face radially formed into the outer circumferential surfaces of said annular retaining key segments, said annular retaining key segments having at least one additional shear nodule with a highly sloped front face and a substantially vertical rear face radially formed into the outer circumferential surfaces of said annular retaining key segments, said first shear nodule having a shear-resisting area across its base and said first shear nodule having a corresponding opposing shear-resisting area in said head closure member, said shear-resisting area of said first shear nodule and said corresponding opposing shear-resisting area of said first shear nodule in said head closure member each having a radial spatial projection, said additional shear nodule having a shear-resisting area across its base and said additional shear nodule having a corresponding opposing shear-resisting area in said head closure member, said shear-resisting area of said additional shear nodule and said corresponding opposing shear resisting area of said additional shear nodule in said head closure member each having a radial spatial projection, with said additional nodule being positioned immediately adjacent to said first shear nodule, so that the radial spatial projection of the shear-resisting area of said additional shear nodule overlaps the radial spatial projection of the corresponding opposing shear-resisting area of said first shear nodule in said head closure member, so that reductions in the overall width of said annular retaining key segments, in the length of said head closure member, and in the thickness of said planar head closure end-cover are enabled, said first and additional shear nodules being adapted to engage said first and additional annular grooves radially formed into the surface of said internal cylindrically-shaped closure member, said retaining key segments being further adapted to engage said head closure end-cover so as to constrain said head closure end-cover against movement in response to the internal working pressure of said head closure apparatus; and (d) means for removably biasing said annular retaining key segments in engagement with said head closure end-cover and said first and additional shear nodules in engagement with said first and additional annular grooves.

5. An improved retaining key apparatus for constraining the end-cover of a heat exchanger head closure member having a cylindrically-shaped internal closure chamber, of the type generally comprising (i) a plurality of annular retaining key segments each having a plurality of shear nodules with vertical front and rear faces radially formed into the outer circumferential surfaces of said annular retaining key segments, said shear nodules being adapted to engage a plurality of corresponding annular grooves having vertical front and rear faces radially formed into the surface of said cylindrically-shaped internal closure chamber, said retaining key segments being further adapted to engage said end-cover for the purpose of constraining said end-cover against movement in response to the internal working pressure of said heat exchanger head closure, and (ii) means for removably biasing said annular retaining key segments in engagement wit said end-cover and said plurality of shear nodules in engagement with said plurality of corresponding annular grooves, wherein the improvement comprises a plurality of annular retaining key segments, each having a first shear nodule with a substantially vertical front face and a substantially vertical rear face radially formed into the outer circumferential surfaces of said annular retaining key segments, said annular retaining key segments having at least one additional shear nodule with a highly sloped front face and a substantially vertical rear radially formed into the outer circumferential surfaces of said annular retaining key segments, said first shear nodule having a shear-resisting area across its base and said first shear nodule having a corresponding opposing shear-resisting area in said head closure member, said shear-resisting area of said first shear nodule and said corresponding opposing shear-resisting area of said first shear nodule in said head closure member each having a radial spatial projection, said additional shear nodule having a shear-resisting area across its base and said additional shear nodule having a corresponding opposing shear-resisting area in said head closure member, said shear-resisting area of said additional shear nodule and said corresponding opposing shear-resisting area of said additional shear nodule in said head closure member each having a radial spatial projection, with said additional shear nodule being positioned immediately adjacent to said first shear nodule, so that the radial spatial projection of the shear-resisting area of said additional shear nodule overlaps the radial spatial projection of the corresponding opposing shear-resisting area of said first shear nodule in said head closure member, so that reductions in the overall widths of said annular retaining key segments, in the length of said head closure member, and in the thickness of said end-cover are enabled, said first and additional shear nodules being adapted to engage corresponding annular radially-formed grooves in the surface of said cylindrically-shaped internal closure chamber, said annular retaining key segments being further adapted to engage said end-cover so as to constrain said end-cover against movement in response to the internal working pressure of said heat exchanger head closure member.

* * * * *